United States Patent [19]

Harada

[11] 4,190,841

[45] Feb. 26, 1980

[54] CAR ANTENNA SYSTEM WITH BIMETALLIC CONTROL MEANS

[75] Inventor: Jiro Harada, Tokyo, Japan

[73] Assignee: Harada Industry Co., Ltd., Tokyo, Japan

[21] Appl. No.: 925,811

[22] Filed: Jul. 18, 1978

[30] Foreign Application Priority Data

Dec. 27, 1977 [JP] Japan ..... 52-159241

[51] Int. Cl.[2] ..... H01Q 1/10

[52] U.S. Cl. ..... 343/903; 343/901

[58] Field of Search ..... 343/901-903, 343/711-715

[56] References Cited

U.S. PATENT DOCUMENTS

| | | | |
|---|---|---|---|
| 3,143,696 | 8/1964 | Harris | 343/903 |
| 3,893,125 | 7/1975 | Bellomayre | 343/903 |

FOREIGN PATENT DOCUMENTS

| | | | |
|---|---|---|---|
| 2313447 | 9/1974 | Fed. Rep. of Germany | 343/903 |

*Primary Examiner*—David K. Moore

*Attorney, Agent, or Firm*—Frishauf, Holtz, Goodman, Woodward

[57] ABSTRACT

A car antenna system comprises an expansion-type antenna element, a driving wire with one end connected to the driving end of the antenna element, a wire transfer mechanism to expand and contract the antenna element by transferring the driving wire in the longitudinal direction thereof, a motor for driving the wire transfer mechanism, a driving power supply circuit including a first power supply circuit for rotating the motor in one direction and a second power supply circuit for rotating the motor in the opposite direction, and first and second circuit breakers connected, respectively, to the first and second power supply circuits for breaking overcurrent flow in each corresponding power supply circuit when the antenna element reaches the expansion or contraction limit.

9 Claims, 12 Drawing Figures

CAR ANTENNA SYSTEM WITH BIMETALLIC CONTROL MEANS

BACKGROUND OF THE INVENTION

This invention relates to an antenna system mounted on a vehicle, such as a car, and more specifically to an antenna system including an expansion-type antenna element capable of being expanded and contracted by remote control.

There are various antenna systems in which an expansion-type antenna element is controlled from a remote place, e.g. a driver's seat. Most of these systems, however, are so constructed that the antenna element may be expanded and contracted by means of a driving wire with the turning effort of a motor transmitted thereto. In this type of antenna system, electric power supplied to the motor needs to be automatically interrupted on completion of the expanding or contracting operation of the antenna element. As means for automatically disconnecting the power supply, there are generally used means to open a contact in a power supply line when a motor or a rotating drum for winding and rewinding the driving wire reaches a predetermined speed of revolution, by means of a cam mechanism to revolve in concert with the motor or rotating drum.

Meanwhile, in such type of antenna system, the driving wire stops immediately on completion of the expanding or contracting action of the antenna element, so it is necessary to separate a wire transfer mechanism from the motor, which would go on rotating by the force of inertia even though disconnected from the power supply, thereby preventing the winding from being burnt due to locking of the motor. Therefore, a clutch is interposed between the motor and the wire transfer mechanism so that the motor may race when the expansion or contraction of the antenna element is completed.

Thus, requiring special mechanical parts including a limit switch combining the cam mechanism and the contact and the clutch interposed between the motor and the wire transfer mechanism, the prior art antenna system is complicated in construction, difficult to manufacture, and susceptible to troubles caused by mechanical losses—i.e., it has low reliability. Owing to the clutch it includes, it should suffer substantial clutch noises produced on completion of the expanding and contracting operations of the antenna element.

SUMMARY OF THE INVENTION

The object of this invention is to provide a substantially trouble-free car antenna system with simple construction including an antenna element controlling mechanism capable of expanding and contracting an antenna element with high reliability, and which does not have clutch noises which have conventionally been produced on completion of the expanding and contracting operations.

In order to attain the above object, the car antenna system of the invention is provided with a circuit breaker which is connected to the power circuit of an expansion antenna element driving motor and serves as a limit switch to operate on completion of the expanding or contracting operation of the antenna element to disconnect the motor from the power circuit. That is, overcurrent, which flows through the motor winding when the motor is locked on completion of the expanding or contracting action of the antenna element, becomes nearly 4 to 5 times as high as the current value for the normal rotating operation. Accordingly, the antenna element driving motor may be stopped by detecting such overcurrent and immediately breaking the power circuit.

Since the motor is to be stopped in the aforesaid manner, the car antenna system of this invention requires no such clutch that has widely been used with the prior art systems. Thus, according to the car antenna system of the invention, the system itself may be simple and campact, the incidence of trouble may be reduced, and the expanding and contracting operations of the antenna element may be performed very quietly, freed from the clutch noises.

DETAILED DESCRIPTION OF THE PREFERRED EMBODIMENTS

Figure 1:
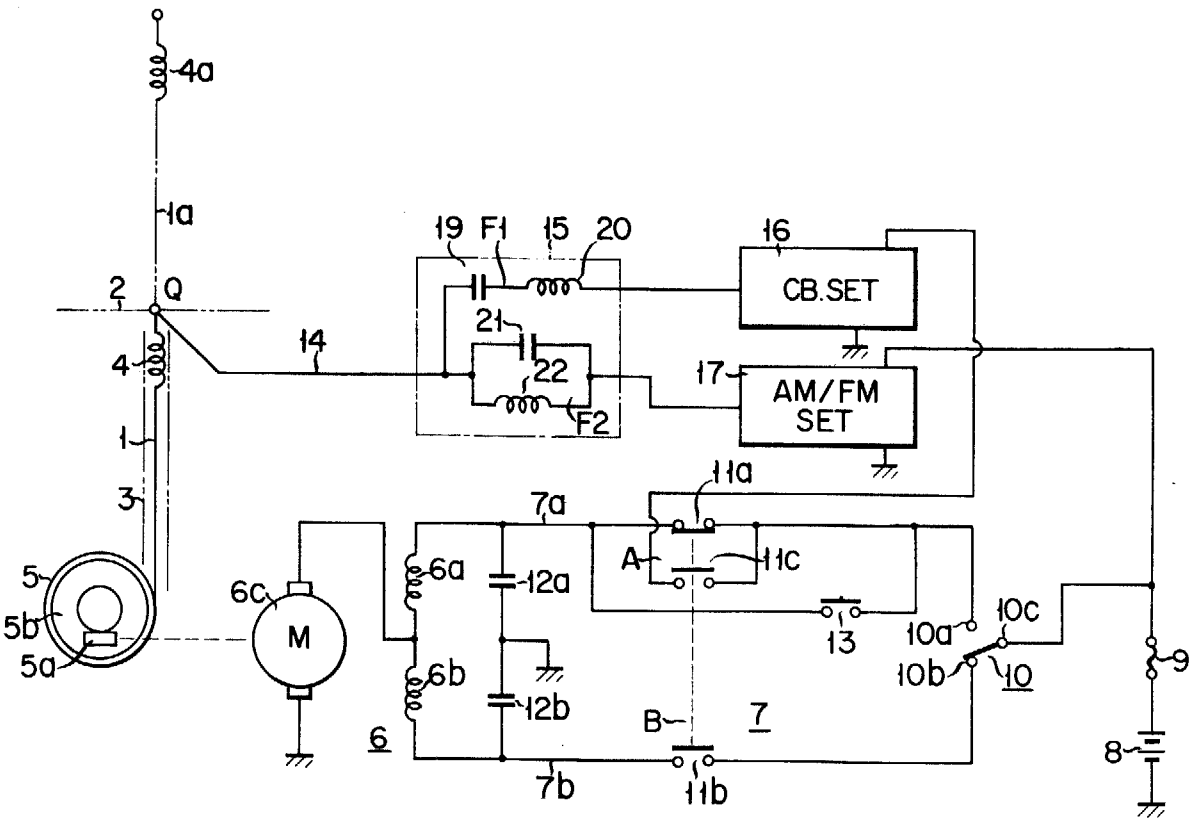
FIG. 1 shows how the car antenna system of this invention is practically used.

FIG. 1 is a diagram of an electric circuit and a few mechanical members related thereto showing an embodiment of this invention. This embodiment is a case in which the invention is applied to a three-wave antenna system capable of receiving amplitude-modulated waves (AM waves) and frequency-modulated waves (FM waves) transmitted from broadcasting stations, and of transmitting and receiving radio-communication waves at frequencies of nearly 27 MHz, called citizen-band waves (hereinafter referred to as CB waves).

In FIG. 1, numeral 1 denotes an expansion-type rod antenna element which is so constructed as to expand and contract, consisting of, for example, a plurality of slidably joined conductor tubes with different diameters. When not used, the antenna element 1 is to be put away in an antenna element holder 3 disposed inside a car body wall 2. A loading coil 4 for the function of transmitting and receiving CB waves is connected in series with the antenna element 1 at the top portion thereof. Numerals 1*a* and 4*a* designate, respectively, the antenna element and the loading coil, the antenna element 1*a* being expanded. A wire transfer mechanism 5 is attached to the bottom end of the antenna element holder 3. The wire transfer mechanism 5 transfers one end side of a driving wire (not shown in FIG. 1) with the other end connected to the driving end of the antenna element 1 (usually the bottom end of a smallest-diameter rod) in the longitudinal direction of the driving wire or of the smallest-diameter rod by means of a feed roller or the like, thereby expanding and contracting the antenna element 1. This wire transfer mechanism 5 is rotated forward or reversely with turning effort transmitted directly from a DC motor 6. A forward rotation expands the antenna element 1, whereas a reverse rotation contracts the element 1. A rotation of the motor 6 is transmitted to the wire transfer mechanism 5 through a reduction gear mechanism consisting of a worm gear 5*a* mounted on the shaft of the motor 6 and a worm wheel 5*b* mounted on the shaft of the wire transfer mechanism 5 so as to engage the worm gear 5*a*, no clutch being interposed between the wire transfer mechanism 5 and the motor 6. The motor 6 is supplied selectively with forward- or reverse-rotation driving power by a driving power supply circuit 7 as mentioned below, thereby revolving forward or reversely.

The driving power supply circuit 7 is constructed as follows. Numeral 8 of FIG. 1 denotes a battery or a carmounted DC power source. The negative electrode of the battery 8 is grounded, while the positive electrode is connected with a common contact 10*c* of an antenna element control switch 10 through a fuse 9. A first branch contact 10*a* of the control switch 10 is connected to one end of a field coil 6*a* for forward rotation of the motor 6 through a switching portion 11*a* of a first circuit breaker A as an upper-limit switch which opens when the antenna element 1 reaches the expansion limit. A second branch contact 10*b* of the control switch 10 is connected to one end of a field coil 6*b* for reverse rotation of the motor 6 through a switching portion 11*b* of a second circuit breaker B as a lower-limit switch which opens when the antenna element 1 reaches the contraction limit. The respective other ends of the field coils 6*a* and 6*b* are connected in common to one end of an armature coil 6*c* of the motor 6. The other end of the armature coil 6*c* is grounded. A series circuit of both these field coils 6*a* and 6*b* is connected in parallel with a series circuit of capacitors 12*a* and 12*b* for absorbing surge voltage generated at the coils 6*a* and 6*b* in response to the start and stop of the motor 6. The junction of the capacitors 12*a* and 12*b* is grounded. Numerals 7*a* and 7*b* denote forward- and reverse-rotation driving power supply lines in the driving power supply circuit 7, respectively.

Meanwhile, the switching portion 11*a* of the first circuit breaker A is accompanied with another switching portion 11*c*. These switching portions 11*a* and 11*c* form the so-called changeover contacts; one is closed when the other opens. One end of the switching portion 11*c* is connected to one end of the switching portion 11*a* (on the side of the first branch contact of the control switch 10), and the other end is connected to the power input terminal of a CB set as mentioned later. The first and second circuit breakers A and B are interlocked. The interlocking relation between these circuit breakers is indicated by the broken line of FIG. 1. The switching portion 11*a* of the first circuit breaker B is closed when the second circuit breaker B opens, and vice versa. The first and second circuit breakers A and B will be further described in detail hereinafter.

Connected in parallel with the switching portion 11*a* of the first circuit breaker A is a manual push-button switch 13 which may be closed only when it is depressed. The push-button switch 13 temporarily short-circuits the switching portion 11*a* of the first circuit breaker A which serves as the upper-limit switch, thereby preventing the operation.

The feeding point of the antenna element 1 is connected with one end of a feed cable 14. The other end of the feed cable 14 is connected to the signal input/output terminal of the CB set 16 through a first filter F1 of a wave separator 15, and further to the signal input terminal of an AM/FM set 17 through a second filter F2 of the wave separator 15. The first filter F1 of the wave separator 15 is composed of a capacitor 19 and a coil 20 connected in series so as to pass CB-wave signals at frequencies of nearly 27 MHz and to arrest AM-wave signals at approximately 500 to 1,600 KHz and FM-wave signals at approximately 90 to 108 MHz. In contrast with this, the second filter F2 of the wave separator 15 consists of a capacitor 21 and a coil 22 connected in parallel so as to pass the AM- and FM-wave signals and to arrest the CB-wave signals.

The CB set 16, which may be provided with, for example, a microphone as a transmitter, a speaker as a receiver, channel selector buttons, etc. (not shown), is a transmitter-receiver so constructed as to allow radio communication between cars or between a car and a base station with CB waves at some 27 MHz. Further the AM/FM set 17, which is provided with a speaker and selector switches (not shown), is a radio receiver so constructed as to receive AM- or FM-waves transmitted from broadcasting stations for radio listeners.

The CB set 16 is supplied with direct current from the battery 8 through the fuse 9, operating switch 10, and the switching portion 11*c* of the first circuit breaker A. The AM/FM set 17 is supplied with direct power from the battery 8 through the fuse 9.

Figure 2:
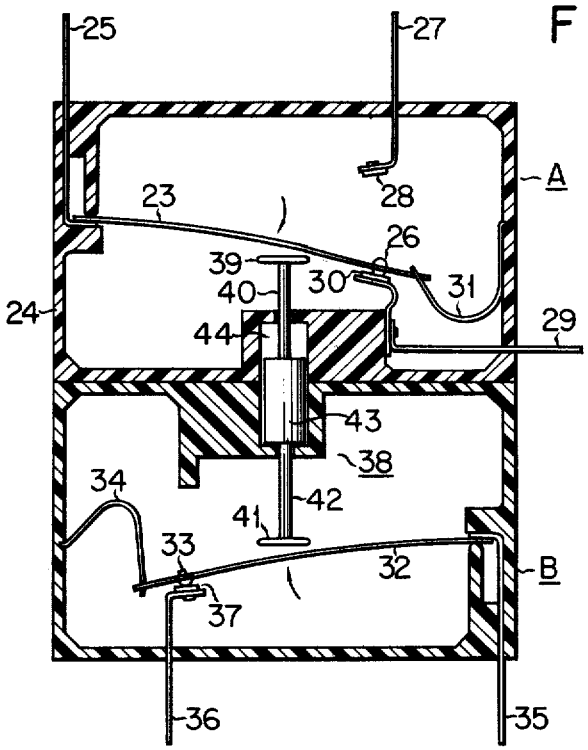
FIG. 2 is a sectional view showing the constructions of circuit breakers A and B as shown in FIG. 1.

FIG. 2 is a sectional view showing the constructions of the first and second circuit breakers A and B. Referring to FIG. 2, numeral 23 denotes a bimetal strip fitted with a travelling contact 26 of the first circuit breaker A and curved by heating caused by an electric current flow through itself. The bimetal strip 23, when heated, is curved in the direction as indicated by the arrow. The base end of the bimetal strip 23 is connected to a terminal 25 which is fixed to the inside wall and the peripheral wall of a case 24 formed of insulating material, such as synthetic resins. Fixed to the tip end portion of the bimetal strip 23 is the contact 26, which comes in touch with a contact 28 fixed to the inside-the-case portion of a terminal 27 fixed to the peripheral wall of the case 24, when the bimetal strip 23 is deenergized. When the bimetal strip 23 is operated, however, the contact 26 of the bimetal strip 23 comes in touch with a contact 30 fixed to the inside-the-case portion of a terminal 29 attached to the peripheral wall of the case 24. Numeral 31 designates a U-shaped spring with one end or tip end rockably connected with the tip end portion of the bimetal strip 23 and the other end firmly held in a recess formed in the inside face of the case 24. The U-shaped spring 31 is formed of highly elastic material, such as phosphor bronze. When energized or supplied with a current flow, the bimetal strip 23, which has been curved upward to bring the contacts 26 and 28 in touch with each other as aforesaid, is transformed into a linear shape, forcing down the tip end of the U-shaped spring 31. So designed as to be bent most sharply to keep the greatest energy when the bimetal strip 23 becomes substantially linear, the U-shaped spring 31 tends to spread out from such sharply bend state when the bimetal strip 23 is further transformed to have its tip end moved opposite to the original position, that is, downward as in FIG. 2. Accordingly, the bimetal strip 23 is forced down by the spring 31 to be curved downward with rapidity, thereby quickly bringing the contact 26 into touch with the contact 30.

If the current flow through the bimetal strip 23 is reduced and the strip 23 is so transformed as to be curved upward, the U-shaped spring 31 is again sharply bent to secure the greatest energy when the bimetal strip 23 is rendered substantially linear. When the tip end of the bimetal strip 23 moves further upward, it is thrusted up rapidly by the force of the U-shaped spring 31 to spread out again, thereby quickly bringing the contact 26 into touch with the contact 28. Whether the contact 26 touches the contact 28 or 30, it is to be pushed by the spreading force of the U-shaped spring 31 to come in touch with the contact 28 or 30 with a predetermined contact pressure. The contacts 26 and 28 correspond to the switching portion 11*a* of FIG. 1, while the contacts 26 and 30 correspond to the switching portion 11*c*.

Meanwhile, numeral 32 of FIG. 2 denotes a bimetal strip fitted with the travelling contact of the second circuit breaker B and curved by heating caused by an electric current flow through itself. The bimetal strip 32, when heated, is curved in the direction as indicated by the arrow. The second circuit breaker B has a substantially the same construction as that of the first circuit breaker A, except for the above detail. Therefore, there will be given simply the names of the parts, omitting the detailed description thereof. Numeral 33 denotes a contact of the bimetal strip 32; 34 a U-shaped spring with the same shape and function as those of the U-shaped spring 31, numerals 35 and 36 terminals, and 37 a contact fixed to the terminal 36. The contacts 33 and 37 correspond to the switching portion 11*b* of FIG. 1. The second circuit breaker B differs from the first circuit breaker A in that it includes no parts to correspond to the terminal 29 and the contact 30 of the first circuit breaker A.

At the junction of the first and second circuit breakers A and B, there is provided a reset-button interlocking mechanism 38. This interlocking mechanism 38 includes an interlocking member or cylinder 43 with each end fitted with a shaft 40 of a reset button 39 in the first circuit breaker A and with a shaft 42 of a reset button 41 in the second circuit breaker B. The cylinder 43 is so formed as to be able to slide in the axial direction within a fixed range through a cylindrical hollow 44 communicating with the case wall surfaces of both breakers A and B. In the circuit breakers as shown in FIG. 2, when the reset button of one circuit breaker is pushed back by the heat-responsive action of the bimetal strip of such circuit breaker, the reset-button interlocking mechanism 38 operates, and the reset button of the other circuit breaker pushes the bimetal strip of the breaker, thereby resetting such other circuit breaker.

Figure 3:
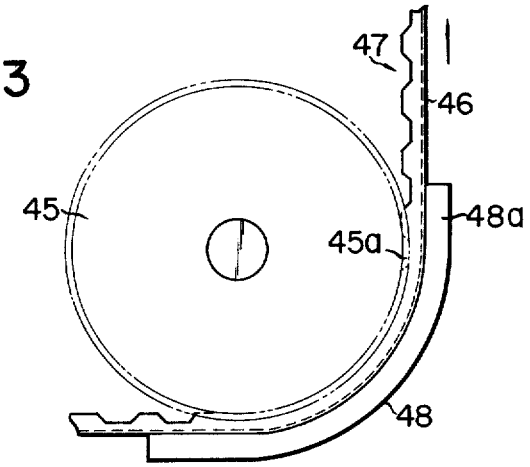
FIG. 3 is a side view of the principal part of a wire transfer mechanism.

FIG. 3 shows the construction of the principal part of the wire transfer mechanism 5 of this embodiment. In FIG. 3, numeral 45 denotes a feed roller to turn along with the worm wheel 5*b* of FIG. 1. The peripheral surface of the feed roller 45 is provided with a rugged surface 45*a* to engage a rugged portion 47 of a driving wire 46 (hereinafter referred to simply as wire). The wire 46, which is formed of suitably elastic material, such as synthetic resins, is provided with the rugged surface 47 longitudinally extending over nearly ⅓ of the circumferential surface of the feed roller 45. Numeral 48 designates a wire guide member for correcting the twist of the wire 46 so that the rugged surface 47 of the wire 46 may face the circumferential surface of the feed roller 45, and for applying a predetermined thrusting force to the back of the wire 46 so as to bring the wire 46 into close contact with the peripheral surface of the feed roller 45. The thrusting force toward the axis of the roller 45 is applied to the guide member 48 by means of a spring (not shown) provided on the back side of the guide member 48.

Figure 4A:
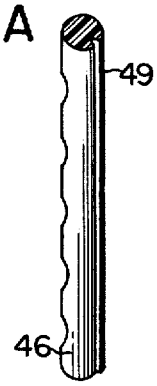
FIGS. 4*a* and 4*b* are perspective views of a driving wire and a wire guide member as shown in FIG. 3, respectively.
Figure 4B:
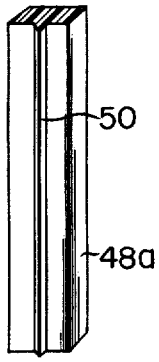

FIGS. 4*a* and 4*b* show the means to correct the twist of the wire 46, including the wire guide member 48. As is clear from FIG. 4*a*, a groove 49 is formed on the back of the wire 46 along the longitudinal direction thereof. An elongated projection 50 to be fitted in the groove 49 of the wire 46 is formed on one side of the wire guide member 48 to come in contact with the back of the wire 46. Therefore, by transferring the wire 46 with the elongated projection 50 of the wire guide member 48 fitted in the groove 49 of the wire 46, the rugged surface 47 of the wire 46 may be allowed surely to face the peripheral surface of the roller 45 when passing through such peripheral surface. Thus, the rugged surface 47 of the wire 46 and the rugged portion formed on the peripheral surface of the roller 45 securely engage each other, thereby preventing slips or other troubles. The wire guide member 48*a* of FIG. 4*b*, which is illustrated in a linear shape, is a linear portion of the wire guide member 48 as shown in FIG. 3, exhibiting the shapes of the groove 49 of the wire 46 as shown in FIG. 4*a* and of the elongated projection 50.

Figure 5A:
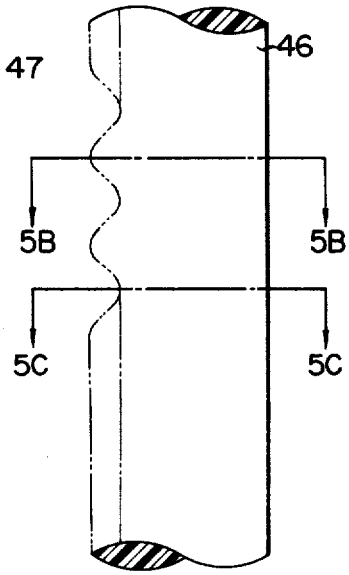
FIG. 5*a* is a side view of another example of the driving wire.
Figure 5B:
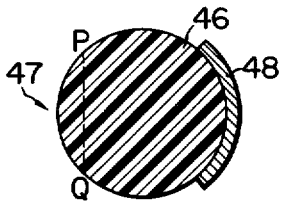
FIGS. 5*b* and 5*c* are sectional views of the driving wire as taken along lines 5*b*—5*b* and 5*c*—5*c* of FIG. 5*a*, respectively.
Figure 5C:
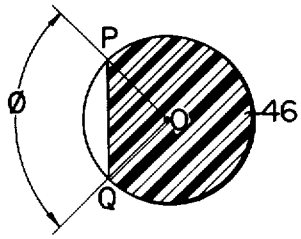

FIG. 5*a* shows another example of the wire 46. The wire 46 has a circular cross section, with the rugged undulated surface 47 (hereinafter referred to as rugged surface) formed on one side (left side of FIG. 5*a*) thereof. FIG. 5*b* is a sectional view of the wire 46 as taken along line 5*b*—5*b* of FIG. 5*a* which passes through a top of the rugged surface 47, exhibiting a circular shape. FIG. 5*c* is a sectional view of the wire 46 as taken along line 5*c*—5*c* of FIG. 5*a* which passes through a bottom of the rugged surface 47, exhibiting the same circular shape of FIG. 5*b* except a portion outside line PQ. An angle formed between points P and Q about the center point O of the wire 46 is approximately 120°. FIG. 5*b* shows a section of the wire guide member 48 with substantially the same curvature as that of the periphery of the wire 46. While in this example the elongated projection 50 and the groove 49 as shown in FIGS. 4*a* and 4*b* are not included, part of the periphery of the wire 46 is guided by the curvature of the wire guide member 48 to get engaged with the rugged portion 45*a* on the roller 45 by means of the rugged portion 47. Accordingly, the wire 46 may smoothly be let out or rolled up accompanying the rotation of the roller 45 without any practical twisting of the wire 46. Since the engagement between the groove 49 and the elongated projection 50 is eliminated, the frictional force caused at the engaging portion is reduced to allow easier expansion and contraction of the antenna element, thereby reducing the abrasion between the wire 46 and the wire guide member 48.

As already mentioned, the wire 46 is made of a synthetic resin with proper elasticity and rigidity, so that the feed roller 45 and wire guide member 48 which coact with the wire 46 are to be formed of selected materials to produce less friction against the wire 46 and hence less abrasion attributable thereto. Thus, those materials may be any metals or plastics in possession of the above properties.

Turning now to FIGS. 1 and 2, there will be described the operation of thus constructed system of the invention. First, when using the CB set 16 and/or the AM/FM set 17, the power switch or switches (not shown) of the set or sets are turned on. For the ease of explanation, described will be the case where both sets are used at the same time. Immediately when the power switches of these sets are turned on, the AM/FM set 17 is supplied with power from the battery 8 to be energized. On the other hand, the CB set 16 will not be supplied with the power because the switching portion 11*c* is opened.

In the initial state, the antenna element 1 is entirely hidden in the holder 3. Therefore, if the AM/FM set 17 is energized as aforesaid, it will be impossible to achieve satisfactory reception of AM and FM waves, excepting for the special high-intensity-field zones.

The expansion of the antenna element 1 may be performed by switching the common contact 10*c* of the control switch 10 to the first branch contact 10*a* side. That is, when the contact 10*c* is operated in this manner, an electric current flows through a closed circuit including the positive electrode of the battery 8, fuse 9, common contact 10*c* of the control switch 10, first branch contact 10*a*, switching portion 11*a* of the first circuit breaker A as the upper-limit switch (here the contacts 26 and 28 (FIG. 2) are in touch with each other), field coil for forward rotation 6*a* of the motor 6, armature coil 6*c* of the motor 6, ground, and the negative electrode of the battery 8. Consequently, the motor 6 turns forward to rotate the rotating drum 5 and the feed roller 45 in the forward direction, transferring the driving wire 46 in the direction as indicated by the arrow of FIG. 3 by means of the feed roller 45. In other words, the wire 46 is let out from the rotating drum 5, whereby the forward end of the wire 46 is forced up into the holder 3 by one end or the driving end of the smallest-diameter rod of the antenna element 1. Thus, the antenna element 1 is pushed out of the holder 3 in due order; the smallest-diameter rod first and the largest last. That is, the antenna element 1 is fully extended from the holder 3 for the normal operation.

In the process of expanding the antenna element 1, a starting current of approximately 4 A and then an operating current of 2 to 3 A flows through the bimetal strip 23 of the first circuit breaker A. Consequently, the bimetal strip 23 generates some heat, while it curves downward as illustrated against the thrusting force of the U-shaped spring 31, the contact 26 never leaving the contact 28. Thus, the switching portion 11*a* remains closed, and the expansion of the antenna element 1 is continued.

When the antenna element 1 is entirely pushed out of the holder to its full length, the wire 46 can be transferred no more. Accordingly, the feed roller 6 and finally the motor 6 are prevented from rotating. In this state, an overcurrent of nearly 10 A flows through the winding of the motor 6. Since such overcurrent flows through the bimetal strip 23 of the first circuit breaker A, the bimetal strip 23 is heated to bend downward as in FIG. 2. That is, the bimetal strip 23 shifts in the direction of the arrow of FIG. 2 against the thrusting force of the U-shaped spring 31, finally quickly bending downward beyond the reversal point of the U-shaped spring 31 or the point where the bimetal strip 26 changes its direction of curvature, and thus the contact 26 is brought into touch with the contact 30. As a result, the switching portion 11*a* of FIG. 1 is opened, and the switching portion 11*c* is closed. Thereupon, the biemtal strip 23 of the first circuit breaker A forces down the reset button 39, as shown in FIG. 2, so that the reset-button interlocking mechanism 38 is actuated to operate the reset button 41 of the second circuit breaker B. Thus, the reset button 41 is moved downward as in FIG. 2 to push the bimetal strip 32 in the direction opposite to the arrow. When the bimetal strip 32 is moved and the reversal point of the U-shaped spring 34 is exceeded, the bimetal strip 32 is quickly shifted downward by the action of the U-shaped spring 34, thereby bringing the contact 33 into touch with the contact 37. That is, the switching portion 11*b* of FIG. 1 is closed.

Since the switching portion 11*a* is opened, the motor 6 is disconnected from the power supply. In this case, the first circuit breaker A functions as the upper-limit switch for the antenna element 1, so that the overcurrent cannot continue to flow through the winding of the motor 6. Meanwhile, since the switching portion 11*c* is closed, the power is supplied to the CB set 16 through the fuse 9, the common contact 10*c* and first branch contact 10*a* of the control switch 10, and the switching portion 11*c*. In this way, the CB set 16 is not supplied with the power to be energized until that point of time or when the expansion of the antenna element 1 is completed.

Thus, a CB-wave output from the CB set 16 is supplied to the antenna element 1 through the first filter F1 of the wave separator 15, and then emitted in the air. On the other hand, a CB wave caught by the antenna element 1 is supplied to the CB set 16 through the first filter F1 of the wave separator 15. Accordingly, communications may be achieved between cars or between a car and a base station. Further, an AM or FM wave caught by the antenna element 1 is supplied to the AM/FM set 17 through the second filter F2 of the wave separator 15. Thus, broadcast waves from broadcasting stations may be received and heard.

The contraction of the antenna element 1 may be performed by switching the common contact 10*c* of the control switch 10 to the second branch contact 10*b* side. That is, when the contact 10*c* is operated in this manner, an electric current flows through a closed circuit including the positive electrode of the battery 8, fuse 9, common contact 10*c* of the control switch 10, second branch contact 10*b*, switching portion 11*b* of the second circuit breaker B as the lower-limit switch (here the contacts 33 and 37 (FIG. 2) are in touch with each other), field coil 6*b* for reverse rotation of the motor 6, armature coil 6*c* of the motor 6, ground, and the negative electrode of the battery 8. Consequently, the motor 6 turns reversely to rotate the wire transfer mechanism 5 in the reverse direction. At the same time, the feed roller 45 is rotated reversely, so that the wire 46 transferred in the direction opposite to the arrow of FIG. 3, and rolled up by the wire transfer mechanism 5. Accompanying the transfer of the wire 46, the antenna element 1 is drawn into the holder 3 in due order; the smallest-diameter rod first and the largest last. When the control switch 10 is operated, the common contact 10*c* is removed from the first branch contact 10*a*, thereby disconnecting the CB set 16 from the power supply. That is, the CB set 16 is automatically deenergized unless the antenna element 1 is fully expanded.

As generally known, the impedance of the antenna element 1 is at a reduced level while it is contained in the holder 3. Therefore, if transmission or reception of CB waves is done with the antenna element 1 contained in the holder 3, reflected waves generated in the antenna circuit may be caused to damage the CB set 16 or other circuit elements, since impedance matching is not achieved between the antenna element side and the CB set side. The present system, however, is safe because the CB set 16 will never be supplied with power unless the antenna element 1 is entirely protruded from the holder 3, as described above.

When the antenna element 1 is entirely drawn in the holder 3, the wire 46 can be transferred no more. Consequently, the motor 6, as well as the feed roller 45, is prevented from rotating. Accordingly, an overcurrent flows through the motor 6. Since the switching portion 11*b* as the lower-limit switch is opened by such overcurrent, the motor 6 is disconnected from the power supply. That is, the overcurrent flows through the bimetal strip 32 of the second circuit breaker B as shown in FIG. 2, thereby heating the bimetal strip 32. As a result, the bimetal strip 32 is energized to curve in the direction as indicated by the arrow of FIG. 2. When the bimetal strip 32 is curved until the reversal point of the U-shaped spring 34 is exceeded, it is further curved upward (in the direction of the arrow of FIG. 2) by the action of the U-shaped spring 34. By such action of the bimetal strip 32, the contacts 33 and 37 are removed from each other, that is, the switching portion 11*b* is opened. When the bimetal strip 32 is operated in this manner, the reset-button interlocking mechanism 38 is actuated. Namely, the reset button 41 is pushed back in the upward direction of FIG. 2 by the bimetal strip 32, so that the reset button 39 in the first circuit breaker A is pushed up. As a result, the bimetal strip 23 of the first circuit breaker A is pushed in the direction opposite to the arrow, and is quickly curved upward by the action of the U-shaped spring 31 when the reversal point of the U-shaped spring 31 is exceeded. Thus, the contact 26 is removed from the contact 30, and is brought into touch with the contact 28. In other words, the switching portion 11*a* of FIG. 1 is closed, and the switching portion 11*c* is opened.

In the aforesaid operations, the switching portions 11*a* and 11*b* serving as the upper- and lower-limit switches need securely be opened on completion of expanding and contracting the antenna element 1, respectively. A requirement for this is that there be a distinct difference between the current flowing through the motor 6 in the process of expanding or contracting the antenna element 1 and the current flowing through the motor 6 on completion of the expansion or contraction of the antenna element 1. In this regard, the present system is free from any slips between the motor 6 and the wire 46, since no clutch is interposed between the motor 6 and the wire transfer mechanism 5, and since the power transmission is achieved by means of the engagement between the respective rugged portions of the feed roller 45 or the principal part of the wire transfer mechanism 5 and the wire 46. Accordingly, there may be provided a distinct difference between the current level in the process of expanding or contracting the antenna element 1 and the current level at time of completion of the expansion or contraction, whereby the first and second circuit breakers as the upper- and lower-limit switches may be operated securely.

If the antenna element 1 is frozen inside the holder 3 in a cold district, a large starting current will flow in expanding the antenna element 1. If the starting current is large, the first circuit breaker A is operated. There may be a case where the antenna element 1 should be expanded in spite of some load on the motor 6. In such case, the mannual push-button switch 13 may be temporarily closed. Connected in parallel with the switching portion 11*a* as the upper-limit switch, the switch 13 can cause a large current to flow through the motor 6 without operating the breaker A.

Further, in the above-mentioned operations, surge voltages, which may be produced when operating the contacts of the first and second circuit breakers A and B as the upper- and lower-limit switches and of the manual push-button switch 13, are absorbed through the capacitors 12*a* and 12*b*. Thus, the circuit elements may be protected.

Figure 6A:
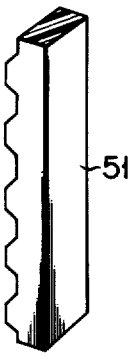
FIGS. 6*a* and 6*b* are perspective views of further examples of the driving wire.
Figure 6B:
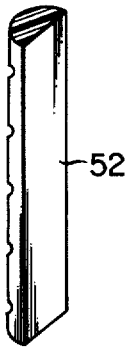
Figure 7:
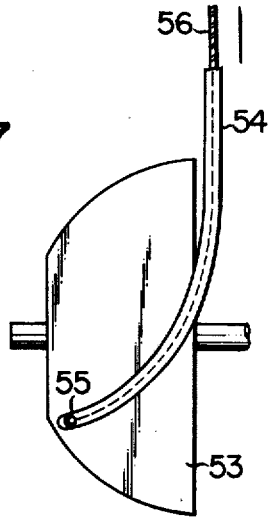
FIG. 7 is a side view of another example of the wire transfer mechanism.

It is to be understood that this invention is not limited to the aforementioned precise embodiment. For example, the cylindrical driving wire, as used with that embodiment, may be replaced by a wire 51 with rectangular cross section as shown in FIG. 6*a* or a semicylindrical wire 52 as shown in FIG. 6*b*. Although in the wire transfer mechanism 5 of the aforesaid embodiment the wire 46 is transferred by means of the feed roller 45 as shown in FIG. 3, the wire transfer mechanism may be so constructed that the wire transfer may be done by winding and rewinding a driving wire 54 by means of forward and reverse rotations of a rotating drum 53, the base end of the wire 54 being fixed to part of the peripheral surface of the drum 53 by means of a pin 55, as shown in FIG. 7. In the wire transfer mechanism 5 as shown in FIG. 7, the base end of the wire 54 is fixed to the end portion of the drum 53 farthest from the wire gate (usually on the extension of the axis of the holder 3), so that the vicinity of the base end of the wire 54 is considerably inclined as against the rotating direction of the drum 53 immediately before the rewinding of the wire 54 is completed, as shown in FIG. 7. Therefore, when the expansion of the antenna element 1 is completed and the transfer of the wire 54 in the direction of the arrow is stopped, the wire 54 is substantially curved by the force of inertia of the motor 6 and the rotating drum 53, as shown in FIG. 7. If the wire 54 is not strong enough, it may be bent or broken, failing to arrest the rotation of the rotating drum 53. In order to avoid such trouble, a core 56 formed of high-rigidity material, such as piano wire and stainless-steel wire, may be inserted in the vicinity of the base end of the wire 54. The core 56 may be solid wire or stranded wire.

Figure 8:
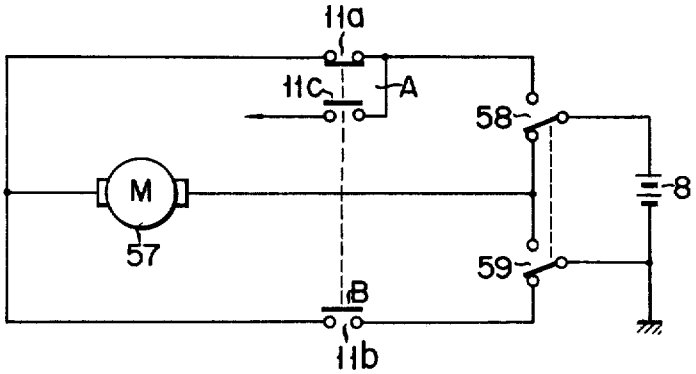
FIG. 8 is a circuit diagram showing another example of the motor and driving power supply circuit for driving the wire transfer mechanism.

Although in the aforementioned embodiment the motor 6 used is of a self-excited series field type and the forward- and reverse-rotation control is performed by switching the polarity of the field coil, the type of motor and the rotation control system may be altered as required. FIG. 8 shows a ferrite motor 57 as an example. In this case, the forward- and reverse-rotation control is done by reversing the polarity of a DC input supplied to the motor 57 by means of changeover switches 58 and 59.

Moreover, in the above embodiment, the power is supplied to the CB set 16 through the switching portion 11*c* in the first circuit breaker A and the common contact 10*c* and first branch contact 10*a* of the control switch 10. However, such power supply may be achieved by opening and closing the line between the battery and the CB set 16 by means of an electromagnetic switch with an exciting coil connected in parallel with the switching portion 11 as the upper-limit switch, without using the switching portion 11*c*.

Further, the antenna element 1 need not always be the rod antenna element as is the case with the above embodiment.

Although in the above embodiment this invention is applied to the three-wave antenna system for common use, i.e. for CB, AM and FM waves, it is to be understood that the invention may be applied also to exclusive-use antenna systems.

According to this invention, there may be obtained the following effects. Since the circuit breakers are used as the upper- and lower-limit switches, there is no need of the clutch between the motor and the wire transfer mechaism that has been deemed essential to the prior art systems, as well as of the limit switch of the conventional type including a cam mechanism and the like. Consequently, highly reliable operations may be expected from the present system, with drastically reduced incidence of trouble due to fewer mechanical losses, as well as reduced number of components used. Moreover, the disagreeable clutch noises that have been caused at the end of the expansion or contraction of the antenna element are eliminated, since the clutch is requred no more.

What is claimed is:

1. A car antenna system for driving an expansion type antenna element between fully expanded and fully contracted states, and for stopping the driving of the antenna element responsive only to the antenna element being in one of its fully expanded or fully contracted states, comprising:

an expansion-type antenna element having a driving end;

a driving wire having one end connected to the driving end of the antenna element;

a wire transfer mechanism for taking up and feeding the driving wire so as to contract and expand the antenna element;

a driving power supply circuit including a first power supply circuit having two terminals and a second power supply circuit having two terminals;

a motor selectively coupled to said first and second power supply circuits for driving the wire transfer mechanism to take up the driving wire when it is connected to the first power supply circuit and to feed the driving wire when it is connected to the second power supply circuit;

a first circuit breaker connected in series with the first power supply circuit and comprising a first stationary contact connected to one of the two terminals of the first power supply circuit and a first bimetal strip having a movable contact, the first bimetal strip being connected to the other terminal of the first power supply circuit, said first bimetal strip normally having the movable contact thereof kept in contact with the first stationary contact to thereby close the first power supply circuit and, when the antenna element expands fully and the motor which is connected to the first power supply circuit becomes unable to rotate, said first bimetal strip bends due to an over current flowing through it to thereby open the first power supply circuit;

a second circuit breaker circuit connected in series with the second power supply circuit and comprising a second stationary contact connected to one of the two terminals of the second power supply circuit and a second bimetal strip having a movable contact, the second bimetal strip being connected to the other terminal of the second power supply circuit, said second bimetal strip normally having the movable contact thereof kept in mutual contact with the second stationary contact to thereby close the second power supply circuit and, when the antenna element contracts fully and the motor which is connected to the second power supply circuit becomes unable to rotate, said second bimetal strip bends due to an over current flowing through it to thereby open the second power supply circuit, said first and second bimetal strips being so designed and arranged relative to each other as to be bent toward each other;

a common interlocking member associated with both the first and second circuit breakers and disposed between the first and second bimetal strips for pushing one of the first and second bimetal strips until the movable contact of the pushed bimetal strip comes into contact with its corresponding stationary contact when the other bimetal strip is bent due to over current flowing through said other bimetal strip;

a first spring in engagement with the first bimetal strip for quickly moving the first bimetal strip to a stable point to release the movable and stationary contacts of the first circuit breaker from each other once the first bimetal strip has passed a change point and to another stable point to bring the movable and stationary contacts of the first circuit breaker into mutual contact once the first bimetal strip has passed the change point, pushed by the interlocking member;

a second spring in engagement with the second bimetal strip for quickly moving the second bimetal strip to a stable point to release the movable and stationary contacts of the second circuit breaker from each other once the second bimetal strip has passed a change point and to another stable point to bring the movable and stationary contacts of the second circuit breaker into mutual contact once the second bimetal strip has passed the change point, pushed by the interlocking member; and a changeover switch for selectively connecting a power source alternatively to the first and second power supply circuits.

2. A car antenna system according to claim 1, wherein said driving wire has a groove cut from the surface thereof and extending in the longitudinal direction thereof.

3. A car antenna system according to claim 2, further comprising a wire guide member extending along the travelling direction of said driving wire and having an elongated projection which engages the longitudinally extending groove of said driving wire to guide said driving wire.

4. A car antenna system according to claim 1, wherein said wire transfer mechanism includes a feed roller engaged with said drawing wire and coupled to said motor to turn in accordance with the rotation of said motor; and means for maintaining engagement between the feed roller and said driving wire.

5. A car antenna system according to claim 4, wherein said driving wire has a substantially circular cross section, and comprises a rugged or undulated surface portion including surface undulations provided at substantially equal intervals in the longitudinal of the wire.

6. A car antenna system acording to claim 5, wherein said rugged or undulated surface portion is formed over nearly a third of the circumference of said driving wire.

7. A car antenna system according to claim 5, wherein said feed roller has a rugged or undulated surface portion on the periphery thereof which is adapted to engage said rugged or undulated surface portion of said driving wire.

8. A car antenna system according to claim 7, wherein said driving wire has a groove cut from the surface thereof and extending in the longitudinal direction thereof.

9. A car antenna system according to claim 8 further comprising a wire guide member extending along the travelling direction of said driving wire and having an elongated projection which engages the longitudinally extending groove of said driving wire to guide said driving wire.

* * * * *